United States Patent [19]

Bender

[11] 4,047,851

[45] Sept. 13, 1977

[54] BELLOWS TYPE EXPANSIBLE CHAMBER PUMP HAVING SEPARATE BIASING MEANS

[75] Inventor: Lloyd F. Bender, Hayward, Wis.

[73] Assignee: Bender Machine Works, Inc., Hayward, Wis.

[21] Appl. No.: 726,834

[22] Filed: Sept. 27, 1976

[51] Int. Cl.[2] ..... F04B 43/00; A61M 1/03

[52] U.S. Cl. ..... 417/412; 92/13.7; 92/46; 92/128; 128/1 D; 222/336; 222/309; 417/472

[58] Field of Search ..... 417/360, 412, 472, 473, 417/; 92/40, 46, 128, 13.2, 13.7; 222/333, 336, 309, 214; 128/1 D; 3/1

[56] References Cited

U.S. PATENT DOCUMENTS

| | | | |
|---|---|---|---|
| 2,592,237 | 4/1952 | Bradley | 92/13.7 |
| 2,960,038 | 11/1960 | Lupfer et al. | 92/40 |
| 3,162,335 | 12/1964 | Kogan et al. | 417/412 |
| 3,195,420 | 7/1965 | Johannsen | 92/128 |
| 3,529,908 | 9/1970 | Smith | 417/472 |
| 3,703,342 | 11/1972 | O'Connor | 417/412 |

FOREIGN PATENT DOCUMENTS

| | | | |
|---|---|---|---|
| 555,331 | 3/1957 | Belgium | 417/472 |

*Primary Examiner*—C. J. Husar
*Attorney, Agent, or Firm*—James E. Nilles

[57] ABSTRACT

A bellows type expansible chamber pump having an exterior spring encircling it for biasing the pump in a suction direction, the pump being completely and quickly disassembled for cleaning purposes. The pump is mounted within an enclosure or box and is driven through an adjustable eccentric by an electric motor. A pump end section sets freely in the bottom of the box and can be manually shifted to prime the pump.

6 Claims, 4 Drawing Figures

BELLOWS TYPE EXPANSIBLE CHAMBER PUMP HAVING SEPARATE BIASING MEANS

BACKGROUND OF THE INVENTION

Many types of dairy equipment or other equipment are required to be cleaned-in-place and this cleaning must be made frequently in order to comply with the sanitation laws of the various states. Various materials must be used in the cleaning solution to insure absolute cleaning of the interior of the pipes, etc., for example, an acid must be used to cut the residue milk from the pipes in milking systems. A detergent is also used to thoroughly clean the equipment and when the cleaning cycle is finished, the system must be flushed with clear water and then preferably sanitized. As a result, various sequences of cleaning operations must be performed in timed relationship in such equipment. One example of milk line equipment with which the present invention finds utility is shown in the U.S. Pat. No. 3,191,576 issued June 29, 1965 to L. F. Bender and entitled "Milk Line Releaser and Washing Apparatus". That apparatus utilizes automatically operated releaser apparatus of the vacuum type and in which the cleaning solution is held in a large tank and circulated through the milk line and vacuum releaser apparatus to thoroughly clean the same.

Another example of equipment with which the present invention finds utility is shown in U.S. Pat. No. 3,802,447, issued Apr. 19, 1974 to L. F. Bender and entitled "Automatic Tank Washer with Spin-Burst Mechanism for Washing, Rinsing, and Sanitizing." That apparatus automatically washed milk storage tanks by means of appropriate steps in a washing cycle.

Another example of apparatus with which the present invention finds particularly utility is shown in U.S. Pat. No. 3,921,692 which issued Nov. 25, 1975 to Rolyn A. Schmid and which has been assigned to an assignee common with the present invention. The pump in that patent performed satisfactorily, but is subject to difficulties in manufacturing and operation due to the concentricity problems required in its construction. Furthermore, that pump was costly to manufacture.

Pumps of the character to which the present invention pertains are used in equipment such as cleaning-in-place apparatus and must be simple, effective, and easy to clean. Pumps of this character must also be kept sterile and in order to facilitate such cleaning, it is necessary that each component used in milk handling equipment be as simple as possible and easily assembled and disassembled. Furthermore, as these pumps are frequently used to pump different fluids, or for other purposes, they must be frequently stopped and started and heretofore it has been a problem to prime such pumps each time it is desired to again start them.

Furthermore, these pumps must be stable in use, economical to manufacture, reliable in operation and adjustable and primed in a quick and easy manner.

SUMMARY OF THE PRESENT INVENTION

The present invention provides a bellows type expansible chamber pump having a resilient, corrugated bellows having opposite ends including a generally flat seating surface and an annular engaging member. The pump also includes end sections, each having a flat surface for being firmly seated on opposite flat surfaces of the bellows. The end sections can be easily and quickly separated and attached to the bellows of the pump. The pump also includes a separate biasing means in the form of a large spring that encircles the bellows and abuts against and between flanges on the end sections to bias the pump to an extended position. The pump is located within an enclosure or box and more specifically, one end section of the pump is located and seats in a lower wall of the box in a stable manner. This end section then extends downwardly from the box and can be grasped by the operator and reciprocated, thus priming the pump in an easy manner. The pump is electrically driven by an adjustable eccentric located in the box and abutting against the other section of the pump. The entire pump can be easily primed and quickly assembled and disassembled for complete and frequent cleaning.

Another aspect of the invention relates to a pump of the above type in which the eccentric means for driving the pump includes an inner eccentric portion and an outer portion surrounding the inner portion, which are rotatably adjustable relative to one another.

These and other objects and advantages of the present invention will appear hereinafter as this disclosure progresses, reference being had to the accompanying drawings.

DESCRIPTION OF A PREFERRED EMBODIMENT

Figure 2:
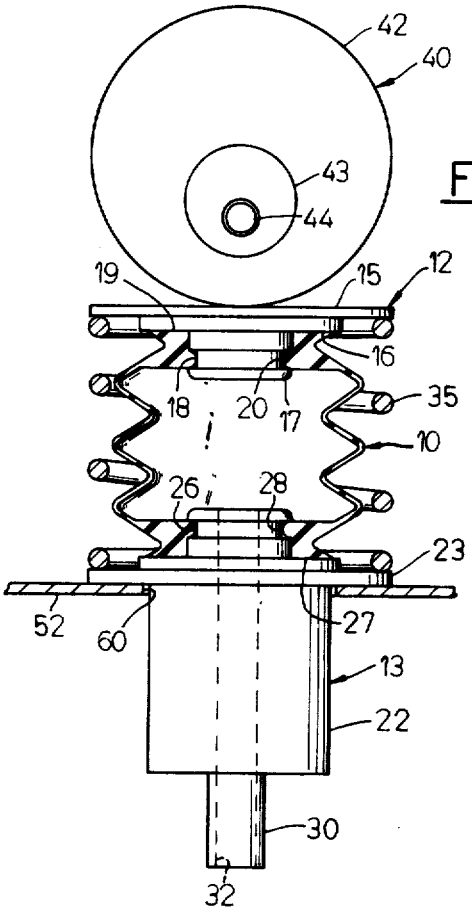
FIG. 2 is a view taken along the line 2—2 in FIG. 1, but on an enlarged scale and partially in section and showing a bellows type expansible chamber pump provided by the present invention.
Figure 3:
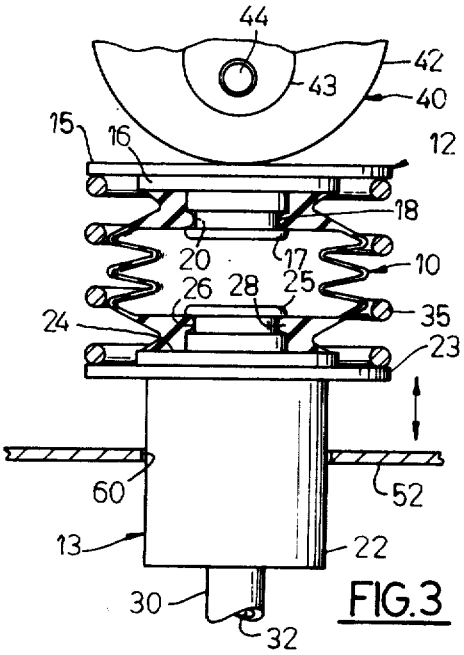
FIG. 3 is a view similar to FIG. 2, but showing the pump when the lower housing thereof has been raised so as to prime the pump.
Figure 4:
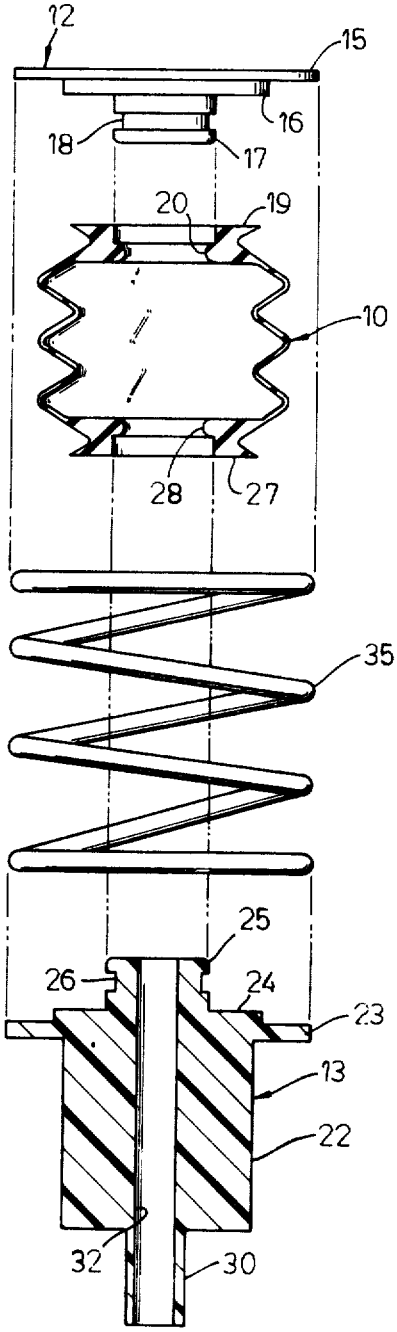
FIG. 4 is an exploded view of the pump showing portions in section.

The pump shown in FIGS. 2 to 4 includes a corrugated bellows 10 formed of resilient material such as rubber or the like, and a pump end section 12 and another pump end section 13. End sections 12 and 13 are preferably made of plastic and are each easily and quickly snapped into engagement with the bellows 10.

More specifically, the end section 12 has an outwardly extending flange 15, a central generally flat surface 16, and a center stem member 17 having a groove 18 formed around its periphery, all formed as an integral piece. One end of the bellows is formed as a flat surface 19 which seats firmly on the flat surface 16 of section 12 for good support thereby and so that no tilt or wobbling therebetween occurs. The bellows also has a radially inwardly extending annular ridge 20 adjacent its end and which is adapted to be slipped over the center stem 17, the ridge 20 being snapped into tight fitting engagement in the groove 18. The other end section of the pump includes a relatively large, cylindrical portion 22, an outwardly extending flange 23, an intermediate flat surface 24, and a central stem portion 25 having a groove 26 around its periphery and intermediate its length. The other end flat surface 27 of the bellows sets squarely and firmly against the surface 24 of the end section 13. An inwardly extending annular ridge 28, similar to ridge 20 in the lower portion of the bellows is adapted to snap into releasable engagement with the groove 26.

The lower housing 13 also has a conduit attaching, reduced portion 30 extending from its lower end. A central passage 32 extends completely through the lower housing 13.

A separate biasing means is provided for the pump in the form of a large coil spring 35 which encircles or surrounds the bellows 10 and its ends abut against and nest on the flange 15 of the upper housing and the flange 23 of the lower housing. The spring 35 acts to bias the pump to the extended or expanded position.

In recapitulation, the expansible chamber pump provided by the present invention includes a bellows which has a generally flat seating surface at each of its opposite ends and also has an annular engaging member in the form of the above mentioned ridges adjacent each of its ends. The pump also includes two end sections, each of which have a generally flat surface which abuts firmly against the corresponding adjacent flat surfaces of the ends of the bellows. Both of the pump end sections also have annular grooves for the snap fit reception with the flanges located adjacent the bellows ends and forming annular engaging members therewith. The pump end sections also have radially outwardly extending flanges which extend radially beyond the bellows and a coil spring surrounds the bellows and abuts against and between the outwardly radially extending flanges of the end sections thus urging them apart in a pump extending direction.

Means are provided for driving the pump in the pumping, contracting direction and this means includes an eccentric means 40. This eccentric means includes an outer eccentric member 42 which is rotatably and adjustably mounted on inner eccentric member 43 which in turn is driven by an electric motor shaft 44 and fixed thereto by a set screw 46. Another set screw 47 (FIG. 1) is provided between the eccentric member to hold them in a selected position. By adjusting the relative position of these members, the throw of the pump can be adjusted. Shaft 44 extends from an electric motor 45 and is driven by it to thereby in turn drive the eccentric means and cause the pump to be rapidly driven in a downward or pumping direction against the bias of the spring 35.

The pump and its eccentric driving means are mounted in an enclosure or box 50 having an easily removable front cover 51 secured by screws 51*a*. The box also has a lower wall 52 and a side wall 53 and the electric motor 45 is mounted on the side wall 53 and its shaft 44 extends into the box as clearly shown in FIG. 1. The pump and more particularly the pump end section 13 is freely mounted in an aperture 60 formed in the lower wall 52 of the box. As shown in FIGS. 2 and 3, the end section 13 extends downwardly from the box and can be grasped by the operator to shift the pump end section in an upward direction, as shown in FIG. 3, against the bias of the spring, thereby easily priming the pump wherever necessary. The entire pump is stable and non-tiltable in its mounting within the box due to the nature and arrangement of the upper and lower pump end sections, the spring mounted firmly therebetween, and the flange 23 of the pump section 13 seating firmly on the lower wall 52 of the box. Furthermore, the bellows is firmly but releasably attached in a stable manner to the pump end sections and no tilting or wobbling between any of the pump parts or between the pump and the box occurs.

The pump can be easily and quickly primed by reciprocating, i.e. lifting, the pump end section 13, permitting it to be returned by the spring in rapid sequence. The lower housing seats freely in the aperture 60 of the box, the spring is large and forming a stable support, and no additional support or guides are required in order to stabilize the pump. No bolts or other fastening devices to hold the pump in assembled relationship are required. The spring offers good rigidity to the pump, self-alignment of the pump, and easy and quick assembly thereof.

Figure 1:
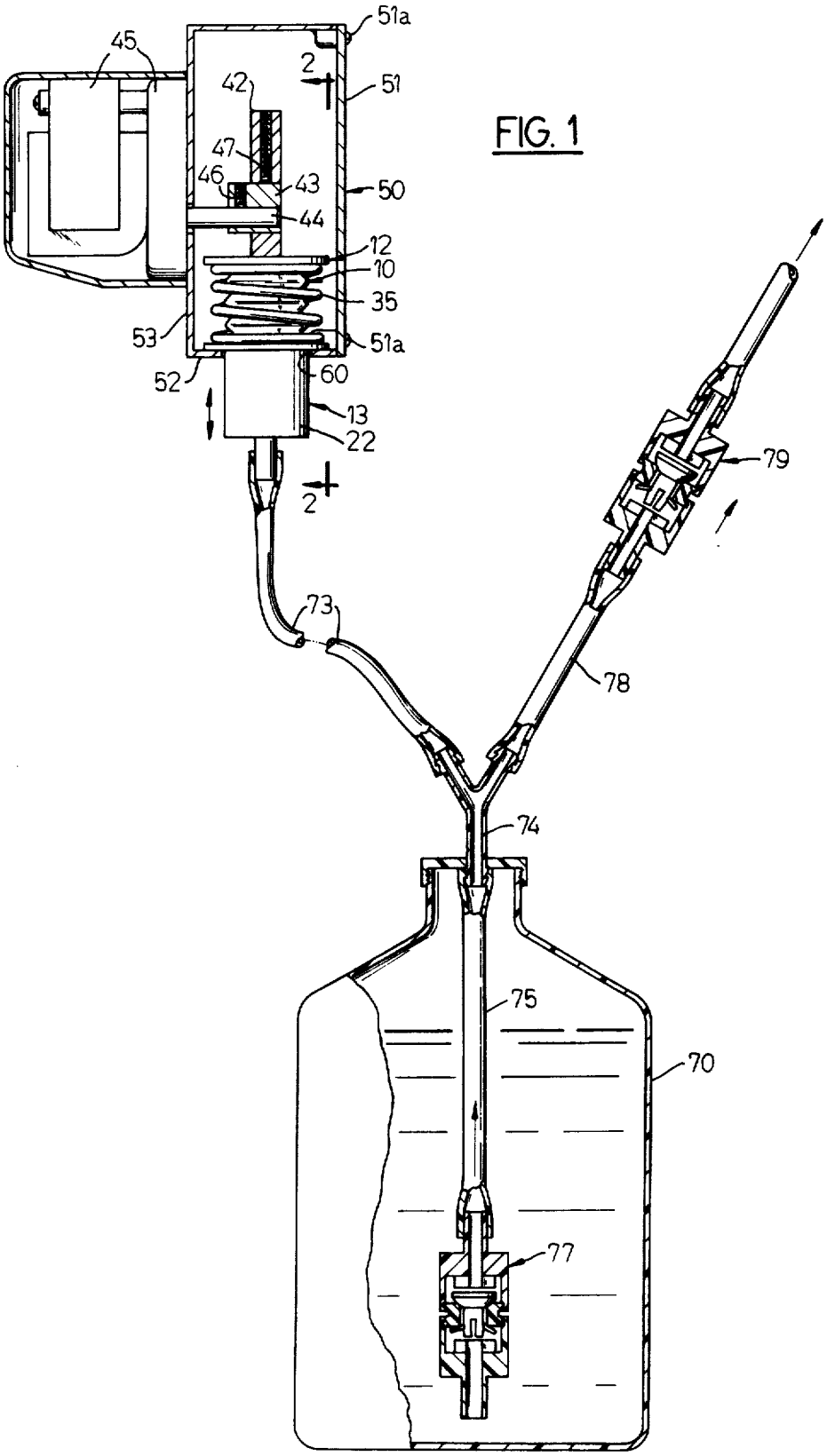
FIG. 1 is an elevational view, partially in section, of pumping apparatus embodying the present invention.

Referring to the apparatus shown in FIG. 1 and with which the pump is used, a liquid container 70 is used to store liquid such as cleaning solution, detergents, acids or rinse solutions, these liquids all being used in dairy equipment, for example. The apparatus includes a flexible transmission element in the form of an elongated flexible conduit 73 which is removably attached to the portion 30 of the pump and is also attached to a Y-fitting 74 which in turn is also connected to a conduit 75 within the container 70. A one-way check valve 77 is located at the lower end of the conduit 70 and permits fluid to be sucked up into the conduit 75 by the pump, but prevents its return to the container. The Y-fitting is also connected to another flexible conduit 78 and this conduit also has a one-way check valve 79 which permits fluid to flow in a direction from the container, but prevents its return thereto.

The arrangement shown in FIG. 1 is such that fluid sucked up from the container by the pump never enters the pump itself. This is possible because of the volumetric sizing of the conduit 73 and the capacity to pump regardless of the suction capacity of the pump as determined by the adjustable cam means. Thus, when the pump is urged to its expanded position by the spring 35, it acts to suck fluid from the container and into the conduit 73. When the eccentric means is rotated by the electric motor 45 so that its pump is contracted in a pumping stroke, the fluid is then pushed from conduit 73 into conduit 78 and through the check valve 79.

The pump provided by the present invention requires no lubrication and presents no concentricity problems in its manufacture or operation. The entire pump can be easily and quickly disassembled for easy and frequent cleaning and at the same time the pump is stable in its mounting without special attaching elements. Furthermore, the pump can be easily, quickly, and manually primed without disassembly of any parts or the need for any tools.

I claim:

1. A bellows type expansible chamber pump comprising a resilient, corrugated bellows having opposite ends and having a generally flat seating surface at each of its opposite ends and also having an annular engaging member adjacent each of its ends, a first pump end section having a generally flat surface adapted to abut firmly against one of said flat surfaces of said bellows ends, said first pump end section also having a radially extending flange extending radially beyond said bellows, said first pump end section also having an annular engaging member forming a quickly releasable tight snap fit with one of said annular engaging members of said bellows, a second pump end section having a radially extending flange which extends radially beyond said bellows and also having a generally flat surface which is adapted to abut firmly against the other flat surface of said bellows, said second end section also having annular engaging means which forms a quickly releasable snap fit with said other annular engaging means of said bellows, a coil spring surrounding said bellows and abutting against and between said radially extending flanges of said end sections urging them apart in a pump extended direction.

2. The pump set forth in claim 1 in combination with a box in which said pump is mounted, said box having a wall with an aperture therethrough, one pump end section extending through said aperture and shiftable therein and relative to said other pump end section so as to provide a priming action to said pump.

3. The combination set forth in claim 2 including a driven eccentric means in said box and engageable with said other pump end section for driving the pump in the contracted, pumping direction.

4. The combination set forth in claim 3 further characterized in that said driven eccentric means includes a driven rotary inner eccentric portion and an outer portion mounted on said inner eccentric portion, means between said portions for rotatably adjusting their relative positions to vary the throw of said eccentric means, and an electric motor mounted on said box and having a driven shaft connected to said inner eccentric portion for rotatably driving the latter.

5. A pump and drive means assembly for use in cleaning-in-place dairy equipment, an easily assembled and disassembled bellows type expansible chamber pump in combination with a box in which said pump is mounted, said pump comprising, a resilient, corrugated bellows having opposite ends and having a generally flat seating surface at each of its opposite ends and also having an annular engaging member adjacent each of its ends, a first pump end section having a generally flat surface adapted to abut firmly against one of said flat surfaces of said bellows ends, said first pump end section also having a radially extending flange extending radially beyond said bellows, said first pump end section also having an annular engaging member forming a quickly releasable tight snap fit with one of said annular engaging members of said bellows, a second pump end section having a radially extending flange which extends radially beyond said bellows and also having a generally flat surface which is adapted to abut firmly against the other flat surface of said bellows, said second end section also having annular engaging means which forms a quickly releasable snap fit with said other annular engaging means of said bellows, a coil spring surrounding said bellows and abutting against and between said radially extending flanges of said end sections urging them apart in a pump extended direction; said box having a wall with an aperture therethrough, said second pump end extending outwardly through said wall and having its flange abutting firmly but resiliently against the interior of said wall and urged thereagainst by said spring, said second pump end section being reciprocal within said aperture for priming said pump, and drive means mounted in said box and engaging and driving said first pump end to impart a pumping stroke to said pump.

6. The assembly set forth in claim 5 including an electric motor mounted on said box and having a rotatable drive shaft extending therefrom and said drive means comprises a rotary eccentric portion fixed on said drive shaft for rotation thereby and an outer portion rotatably mounted on said inner eccentric portion and means between said portions for rotatably adjusting their relative position to vary the throw of said drive means.

* * * * *